US006955323B2

(12) United States Patent
Yomeoka

(10) Patent No.: US 6,955,323 B2
(45) Date of Patent: Oct. 18, 2005

(54) WEB GUIDER

(75) Inventor: Kikuo Yomeoka, Osaka (JP)

(73) Assignee: Zuiko Corporation, Osaka (JP)

( * ) Notice: Subject to any disclaimer, the term of this patent is extended or adjusted under 35 U.S.C. 154(b) by 0 days.

(21) Appl. No.: 10/431,256

(22) Filed: May 7, 2003

(65) Prior Publication Data

US 2003/0213867 A1 Nov. 20, 2003

(30) Foreign Application Priority Data

May 14, 2002 (JP) ..... 2002-138314

(51) Int. Cl.[7] ..... B65H 23/16
(52) U.S. Cl. ..... 242/615.1; 242/615.2
(58) Field of Search ..... 242/615.1, 615.2, 242/534.1, 563.1; 226/21

(56) References Cited

U.S. PATENT DOCUMENTS 4,291,825 A * 9/1981 Glanz ..... 226/18
6,668,526 B2 * 12/2003 Schmidt ..... 53/551

FOREIGN PATENT DOCUMENTS

EP 0 092 735 A2 11/1983

* cited by examiner

*Primary Examiner*—John Q. Nguyen
(74) *Attorney, Agent, or Firm*—Eschweiler & Associates, LLC

(57) ABSTRACT

A web guider comprising a movable section that has an inlet roller for picking up a web, an outlet roller for releasing the web, and a curved rail; and a fixed section that has a guider for guiding the curved rail and a motor for providing a driving force for swinging the movable section; wherein the motor transmits the driving force through a driver of the motor to a follower of the curved rail, an orientation of the movable section is changed by changing a position at which the driver contacts the follower.

20 Claims, 7 Drawing Sheets

FIG.3A
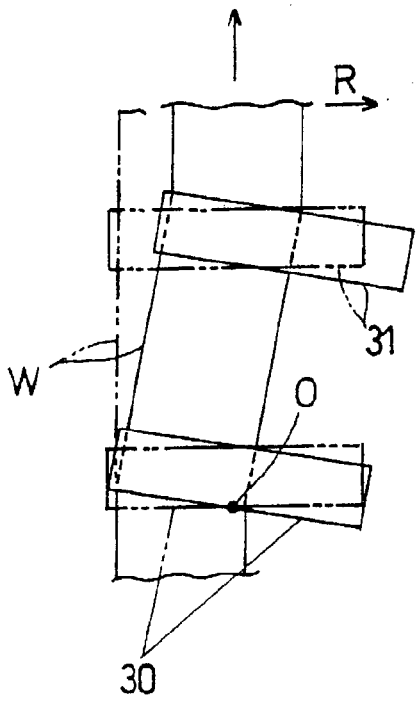
FIG.3B
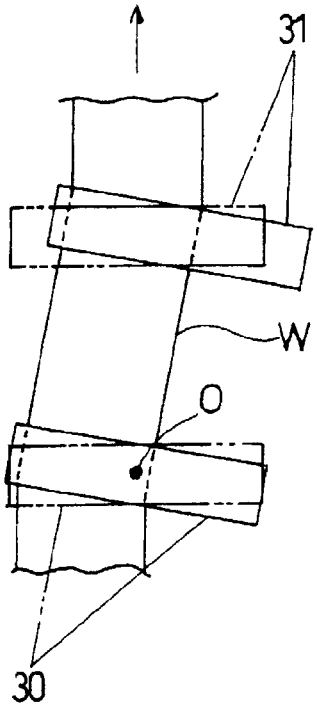
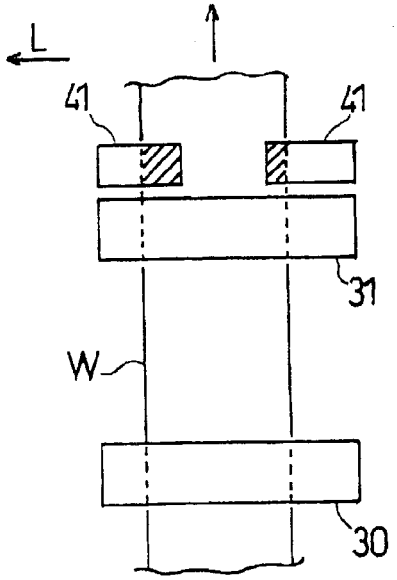
FIG.3C

WEB GUIDER

BACKGROUND OF THE INVENTION

1. Field of the Invention

The present invention relates to a web guider capable of correcting the path along which a web is transferred.

2. Description of the Related Art

When a web is transferred, the web may be shifted toward one edge, thereby shifting the center line of the web from the intended path. In such a case, the shift may be corrected by adjusting the tension on each edge of the web. A web guider known in the art guides a web by a pair of rollers, and the orientation of the rollers with respect to the web can be changed so as to correct the path of the web. For example, a web guider disclosed in European Patent Application No. 0 092 735 corrects the shift of a web by swinging a pair of rollers with a male screw and a female screw meshing with each other.

However, with the straight male and female screws meshing with each other, it is difficult to properly control the mechanism because of the low linearity between the amount by which the screws are turned and the angle by which the rollers are swung.

SUMMARY OF THE INVENTION

The present invention has been made in view of the problem in the prior art, and has an object to provide a web guider that is easy to control.

In order to achieve the object set forth above, the present invention provides a web guider, wherein: an inlet roller for picking up a web and an outlet roller for releasing the web are provided while being spaced apart from each other; a portion of a side surface of each of the pair of rollers is in contact with a surface of the web; a movable section for rotatably supporting the pair of rollers is provided swingably to a fixed section; a driving device for swinging the movable section with respect to the fixed section is provided; an orientation of the pair of rollers with respect to the web is changed as the movable section is swung; the driving device includes a curved rail for guiding the swinging of the movable section, a driver for providing a driving force for swinging the movable section, and a follower for transmitting the driving force from the driver to the movable section, the follower having a shape conforming to the curvature of the rail; and the orientation of the rollers is determined by a position at which the driver contacts the follower.

As the orientation of the pair of rollers with respect to the web flow direction is changed by swinging the movable section, the tension on each edge of the web changes. Thus, the web is moved along the axes of the rollers, thereby changing the path of the web being transferred.

On the other hand, the follower for transmitting the driving force from the driver to the movable section has a shape conforming to the curvature of the rail, thereby providing an increased linearity between the amount by which the driver is driven and the angle by which the rollers are swung even if the swing angle of the rollers is increased. Therefore, it is possible to easily and accurately control the swing angle of the rollers.

Moreover, the driving device includes a curved rail and a follower having a shape conforming to the curvature of the rail, whereby the guider of the present invention can be made smaller, as compared with a case where a set of screws or a joint is used.

In the present invention, the inlet roller and the outlet roller may be generally parallel to each other. Moreover, the length of each roll may be greater than the width of the web, in which case it is preferred that each end of the roll is extending past the corresponding edge of the web, so that the tension on each edge of the web can be adjusted.

The pair of rollers may be in surface contact with the same side of the web, or may alternatively be in surface contact with the opposite sides of the web at remote positions so that the web is not sandwiched by the inlet roller and the outlet roller. Note that the inlet roller comes into surface contact with any portion of the web, before the outlet roller does.

The movable section maybe provided swingably with respect to the fixed section along the plane that includes the axes of the pair of rollers. Alternatively, the movable section may be swingable along a plane that is inclined to, or that crosses, the plane, or may be swingable along a plane that is perpendicular to the plane including the axes of the pair of rollers.

The rail may be curved along a line that is generally an arc whose center is located closer to the inlet roller than to the outlet roller. The term "arc" as used herein is not limited to a portion of a circle, but includes any other arc-like line, e.g., a portion of an ellipse, a parabola, a hyperbola, a sine curve, a cycloid, etc.

The rail may be fixed to the movable section or to the fixed section. When the rail is fixed to the movable section, a guided member to be guided by the rail is provided on the fixed section. On the other hand, when the rail is fixed to the fixed section, a guided member to be guided by the rail is provided on the movable section.

The driver and follower mechanism may be a mechanism including a pinion and a curved rack, a worm and worm wheel mechanism, a screw gear mechanism.

The motor for swinging the frame may be fixed either to the fixed section or the movable section. While the motor may be any of various motors or a solenoid, it is preferred that positional information on the path of the web being transferred is detected by a detector, and the operation of the motor is controlled according to the detection results.

In the present invention, am arm may be provided instead of the rail for guiding the swing movement. For example, the base portion of a swingable arm may be attached to the fixed section while the movable section is attached to the tip of the arm so that the movable section and the arm are swung integrally.

The detector detects a reference position of the web. The opposing edges of the web are typically detected as "reference positions". Alternatively, when a graphical pattern or a picture is printed on the web, it may be detected as a reference position and subjected to an image processing operation so as to generate information on the position of the web.

The means for detecting the reference position may be an ultrasonic sensor, an optical sensor (e.g., an infrared sensor), an air sensor, etc. Alternatively, the deflection of the web may be detected by processing an image data obtained from a CCD camera or a linear sensor (line sensor).

A suitable type of a sensor can be selected depending on the type of the web. For example, if an air easily passes through the web, it is preferred to use an ultrasonic sensor or an optical sensor. If the web is transparent or semitransparent, it is preferred to use an ultrasonic sensor or an air sensor.

Note that the web may be any of various types of web, including a whole cloth for making a disposable worn article such as a disposable diaper, disposable pants, a sanitary napkin, or the like, a whole cloth with apertures, e.g., leg holes, therein, a whole cloth with an elastic member adhered thereto, and a whole cloth with an absorbent layered thereon.

BRIEF DESCRIPTION OF THE DRAWINGS

FIG. 3A to FIG. 3C are schematic plan views illustrating a method for adjusting the path of a web.

DESCRIPTION OF THE PREFERRED EMBODIMENTS

Figure 1A:
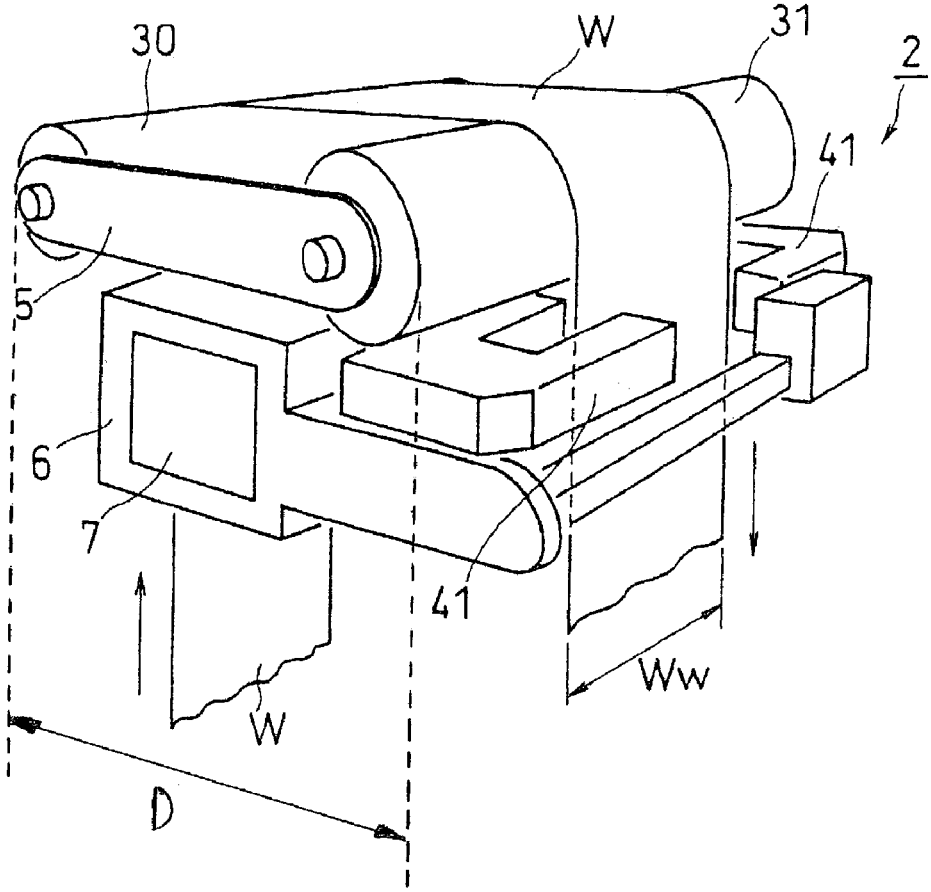
FIG. 1A is a perspective view illustrating a web guider according to one embodiment of the present invention.

An embodiment of the present invention will now be described with reference to the drawings. As illustrated in FIG. 1A, a web guider 2 includes a movable section 5 and a fixed section 6.

The movable section 5 includes an inlet roller 30 for picking up a web W, and an outlet roller 31 for releasing the web W. The rollers 30 and 31 rotatably attached to the movable section 5 while being spaced apart from each other by a predetermined interval. The web W runs around the pair of rollers 30 and 31, and is released from the web guider 2 while being in contact with each part of side surfaces of the inlet roller 30 and the outlet roller 31.

As illustrated in FIG. 1A, each length of the rollers 30 and 31 is set to be greater than the width Ww of the web W. On the other hand, the distance D between the outer edges of the pair of rollers 30 and 31 is set to be ½ or more of the width Ww of the web W. Note that the distance D between the outer edges of the pair of rollers 30 and 31 is preferably equal to or greater than the width Ww of the web W. The rollers 30 and 31 are preferably made of a light material, e.g., an aluminum alloy or a carbon graphite.

The movable section 5 illustrated in FIG. 1A can be rotated with respect to the fixed section 6. The rotation of the movable section 5 changes the orientation of the rollers 30 and 31 with respect to the web W, thereby correcting the path of the web W being transferred.

Figure 2A:
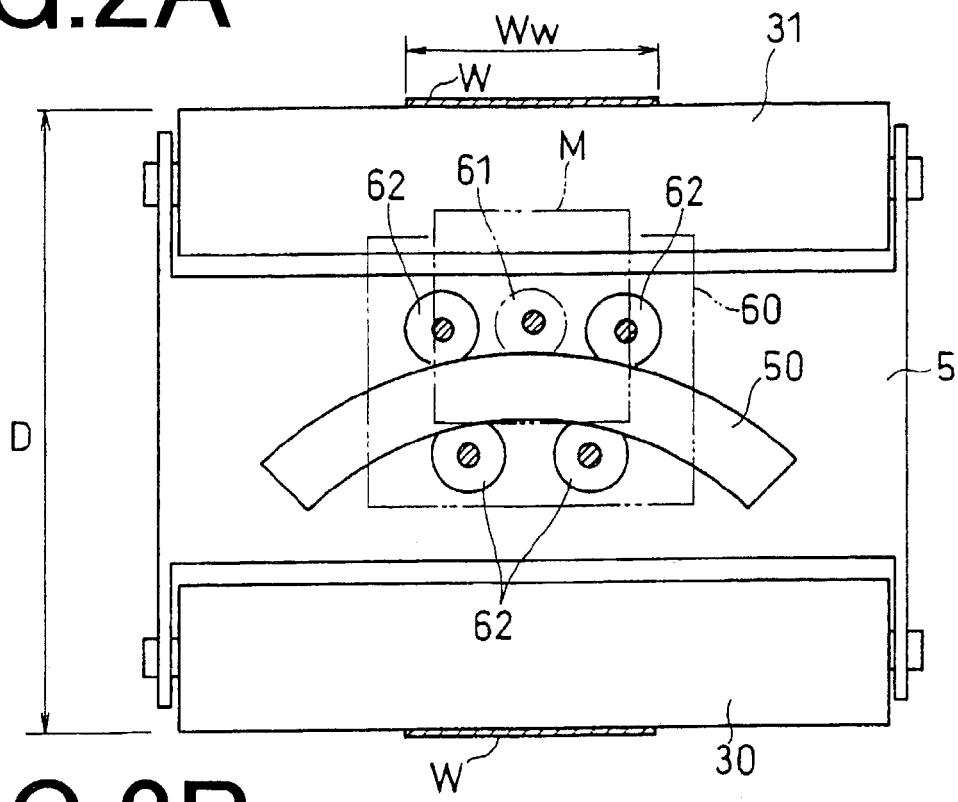
FIG. 2A and FIG. 2B are a cross-sectional bottom view and a cross-sectional top view, respectively, illustrating the web guider.
Figure 2B:
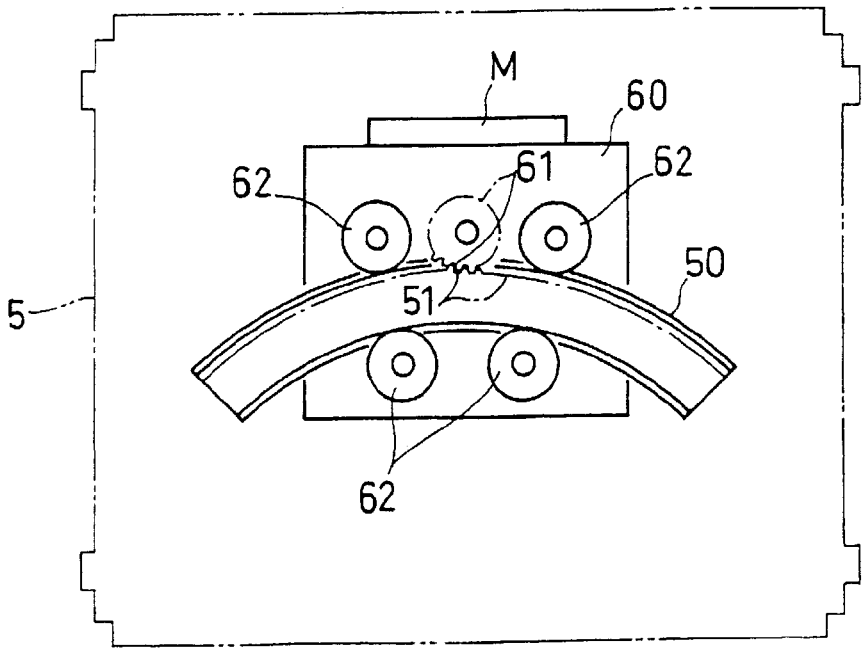

As illustrated in FIG. 2A and FIG. 2B, the movable section 5 includes a rail 50 for changing the orientation of the movable section 5. The rail 50 may be in an arc shape or a U-shape. When the rail 50 is in an arc shape, the movable section 5 is driven about the center O of the arc (FIG. 3A and FIG. 3B). In such a case, the rail 50 is curved so as to protrude toward the outlet roller 31.

In order to prevent the web W from being creased, it is preferred that the center O is located closer to the inlet roller 30 than to the outlet roller 31. Moreover, as illustrated in FIG. 3A, it is most preferred that the center O is located along one edge of the inlet roller 30 that is away from the outlet roller 31.

In a case where the center O is located on one edge of the inlet roller 30 that is away from the outlet roller 31 as illustrated in FIG. 3A, as compared to a case where it is located at the center of the inlet roller 30 as illustrated in FIG. 3B, the change in the position at which the web W is picked up is smaller, thereby better preventing the web W from being creased.

Figure 4A:
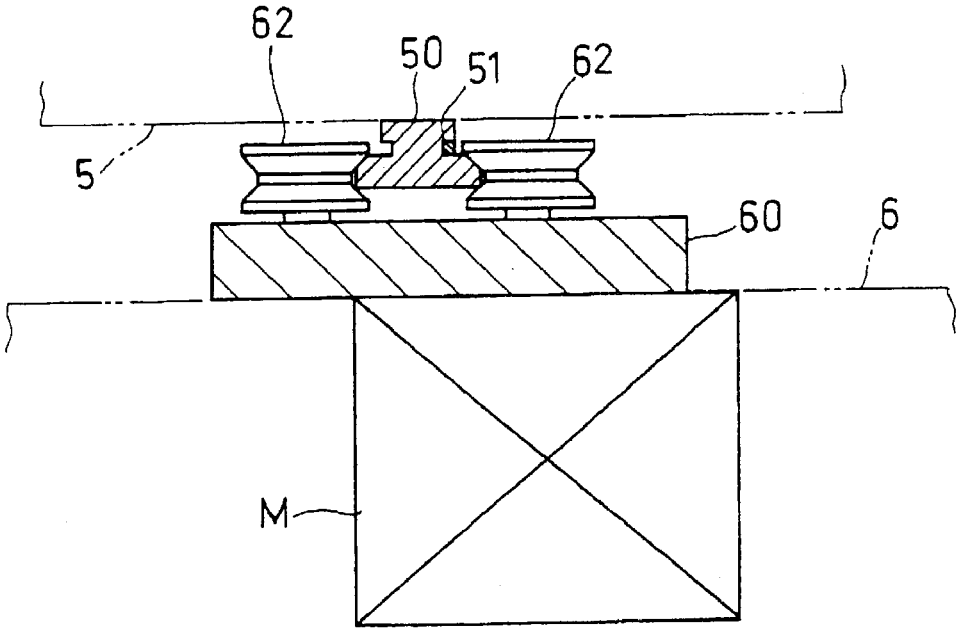
FIG. 4A and FIG. 4B are cross-sectional side views each illustrating the web guider.
Figure 4B:
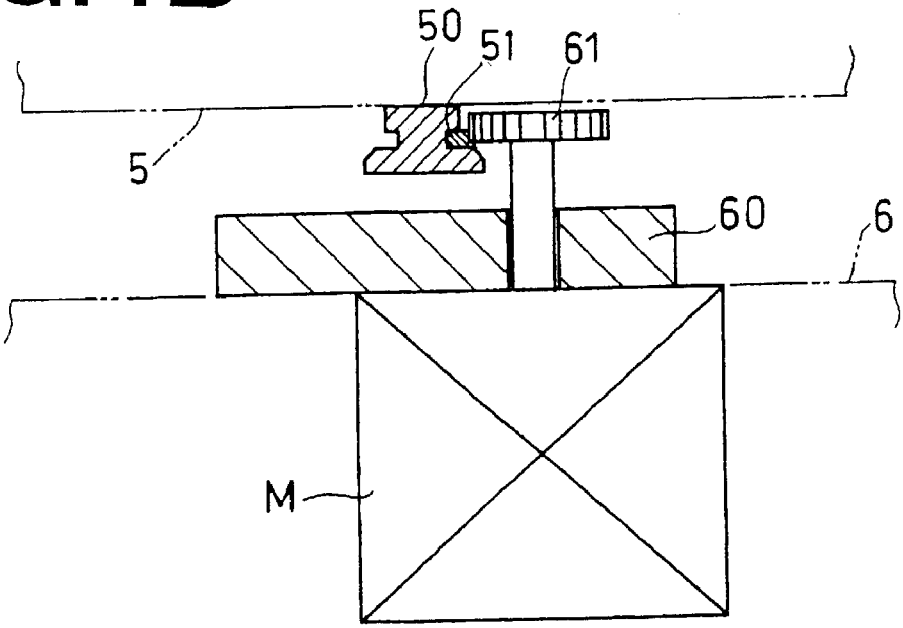

As illustrated in FIG. 4A and FIG. 4B, the fixed section 6 includes a plurality of guide rollers 62, a support section 60 for supporting the guide rollers 62 and a motor M. The guide rollers (guided members) 62 are rotatably attached to the support section 60. The rail 50 is held between the guide rollers 62 for movement along a constant path. Thus, the rail 50 can move between the guide rollers 62 under a small frictional force. In the present embodiment illustrated in FIG. 2A and FIG. 2B, the rail 50 is held by four guide rollers 62. With the rail 50 being held by the guide rollers 62, the rail 50 can move along the predetermined arc about the center O (FIG. 3A) without being shifted substantially.

The motor M includes a driver 61 for providing a driving force for swinging the movable section 5. The driver 61 transmits the driving force from the motor M to a follower 51. The orientation of the rollers 30 and 31 is determined by the position at which the driver 61 and the follower 51 contact each other. The follower 51 may be provided with substantially the same location as the rail 50 with substantially the same curvature.

Specifically, the follower 51, i.e., a rack 51 may be provided along the rail 50, as illustrated in FIG. 2B. Moreover, the motor M may be fixed to the support section 60, with a pinion (driver) 61 provided along the output shaft of the motor M being engaged with the rack 51. As the pinion 61 is spun by the motor M, the rack 51 is moved, whereby the movable section 5 swings to the left and to the right about the center O. Therefore, the orientations of the rollers 30 and 31 provided on the movable section 5 are determined accurately by the position of a gear (engaging portion) of the rack 51 that meshes with the pinion 61. Note that the shape of the rack does not have to be straight, but may alternatively be a curved shape, e.g., an elliptical shape, a parabolic shape, or an arc shape.

The motor M may be a stepping motor. By spinning the motor M, the rollers 30 and 31 are swung by a predetermined angle. The predetermined angle may be in the range of −20° to +20°.

Note that the rack 51 may be provided either on the protruding side of the rail 50 or on the other side (i.e., the side closer to the center O). However, it is preferred that the rack 51 is provided on the protruding side of the rail 50 in order to give a large torque on the movable section 5.

With the provision of the rack 51 along the rail 50, the linearity between the amount by which the motor M is spun and the angle by which the movable section 5 is swung is increased, as compared with a case where a joint, or the like, is used. Therefore, even if the swing angle of the rollers 30 and 31 is large, it is possible to accurately control the swinging of the movable section 5.

Moreover, with the provision of the rack 51 along the arc-shaped rail 50, the swing angle of the rollers 30 and 31 can be increased, as compared with a case where a joint, or the like, is used, as disclosed in U.S. Pat. No. 4,212,419. Thus, the swinging of the rollers 30 and 31 can be controlled over a wide angle range, thereby allowing for a substantial correction of the path of the web W. Furthermore, the guider of the present invention can be made smaller, as compared with a case where a set of screws or a joint is used.

Figure 5:
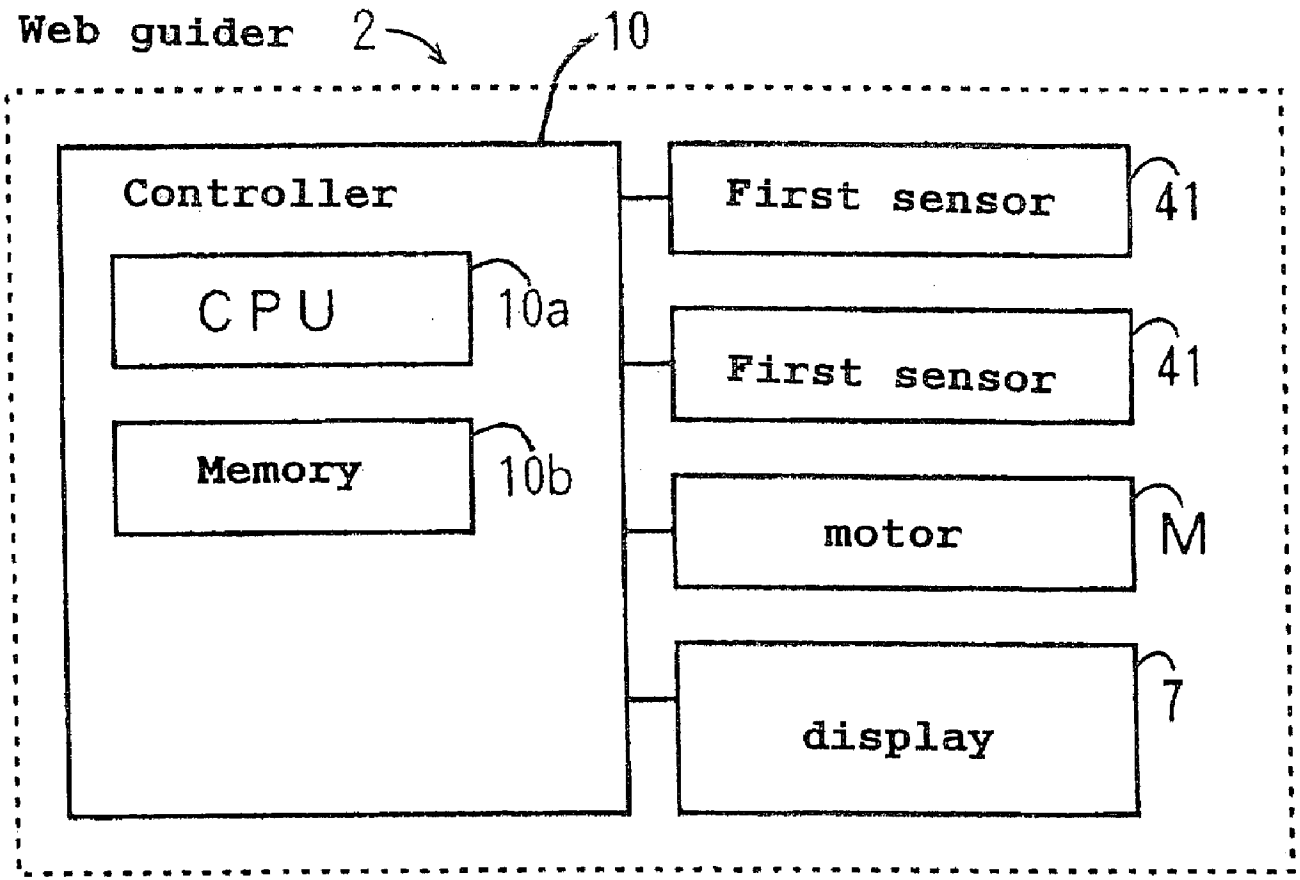
FIG. 5 is a schematic diagram illustrating the configuration of the web guider.

As illustrated in FIG. 5, the web guider 2 may include a sensor for detecting a reference position of the web W, based on which the path of the web W being transferred is defined, so as to output positional information on the detected path, and a controller 10 for controlling the spinning of the motor M based on the positional information from the detector.

Specifically, the controller 10 may be a microcomputer including a CPU 10*a* and a memory 10*b*. At least a first sensor (detector) 41, the motor M, and a display 7 to be described later are coupled with the controller 10 via an interface (not shown). Alternatively, the motor M may be controlled by the controller 10 based on instructions from an external controller.

It is preferred that the first sensors (detectors) 41 are provided downstream of the outlet roller 31, and between the outlet roller 31 and the next roller (not shown) downstream of the outlet roller 31, as illustrated in FIG. 1A. This is because if the first sensors (detectors) 41 are provided downstream of the next roller, the movement of the web W in the width direction is decreased. Note that it is more preferred that the first sensors 41 are provided at a position closer to the outlet roller 31 between the outlet roller 31 and the next roller.

The first sensors 41 can detect the position of the web W. The amount by which the web W is shifted can be determined by detecting an edge (reference position) of the web W with the first sensor 41, for example.

The controller 10 illustrated in FIG. 5 has a manual mode in which the path of the web W is adjusted manually by the operator, and an automatic mode in which it is adjusted automatically by the controller 10 as will be described later.

Figure 1B:
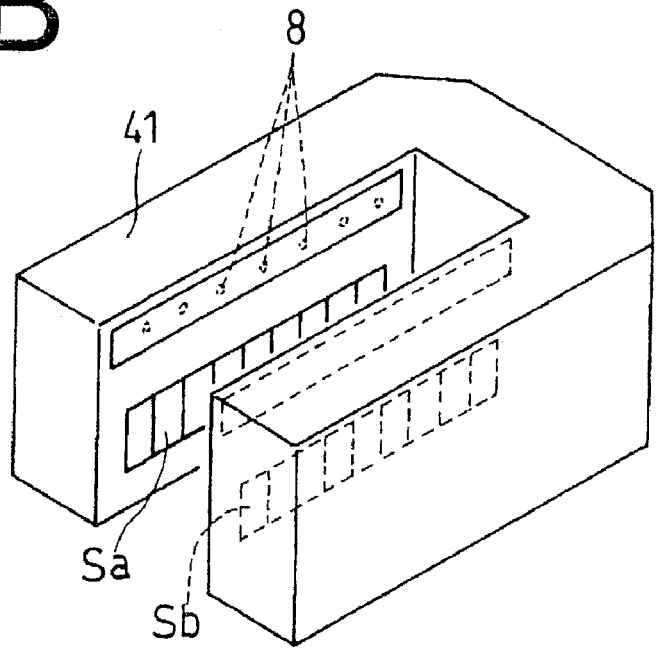
FIG. 1B is a perspective view illustrating a first sensor.

In the automatic mode, the controller 10 may control the path of the web W as follows by using the pair of first sensors 41. For example, the first sensor 41 may include a light emitting section Sa for emitting light and a light receiving section Sb for receiving light from the light emitting section Sa, as illustrated in FIG. 1B.

One of the pair of first sensors 41 illustrated in FIG. 1A detects one edge of the web W, and the other one detects the other edge of the web W. In such a case, the path of the web W may be adjusted as follows. That is, the controller 10 may control the path of the web W so that the value of the detection signal (positional information) output from one of the first sensors 41 is equal to that output from the other one of the first sensors 41. When the path of the web W changes, i.e., deflects to either side, the amount of light received by the light receiving section Sb changes according to the degree of the deflection. The controller 10 may control the spinning of the motor M based on the change in the amount of received light.

For example, as illustrated in the conceptual diagram illustrated in FIG. 3C, when the web W is shifted to the left (the direction indicated by arrow L), the amount of light received by the left-side first sensor 41 decreases while the amount of light received by the right-side first sensor 41 increases. According to the detection signals from the first sensors 41, the controller 10 spins the motor M to swing the rollers 30 and 31 clockwise as illustrated in FIG. 3A, thereby moving the path of the web W to the right (the direction indicated by arrow R).

Note that only one first sensor 41 may be provided, instead of providing a pair of first sensors 41, to detect only one edge of the web W. In such a case, the path of the web W can be adjusted as follows, assuming that the first sensor 41 is an optical sensor.

(1) The operator performs a predetermined operation to record, in the controller 10, a value $L_{MAX}$ of the detection signal that is output from the light receiving section Sb of the first sensor 41 when the light receiving section Sb is not covered by the web W at all.

(2) Then, a value $L_{MIN}$ of the detection signal that is output from the light receiving section Sb when the light receiving section Sb is completely covered by the web W is recorded in the controller 10.

(3) The controller 10 determines the display range of the detection signal based on the recorded values $L_{MAX}$ and $L_{MIN}$. The controller 10 can display the value of the signal output from the light receiving section Sb on the display 7 to be described later in the determined display range. The operator adjusts the position of the first sensor 41 with respect to the web W so that the value of the detection signal becomes equal to the average value between $L_{MAX}$ and $L_{MIN}$ is obtained.

(4) The controller 10 outputs a control signal such that a level $L_R$ of an actual detection signal output from the light receiving section Sb is between $L_{MAX}$ and $L_{MIN}$, and the motor M is spun based on the control signal. For example, a value C of the control signal may be obtained as shown in Expression (1) below:

$$C=A*(L_R-L_{STN}) \quad (1)$$

where $L_{STN}$ is the average value between $L_{MAX}$ and $L_{MIN}$, and A is a constant.

Although the light receiving section of an optical sensor typically has a round shape (for example, U.S. Pat. No. 5,300,787, U.S. Pat. No. 5,379,656, and U.S. Pat. No. 5,442,187), the light emitting section and the light receiving section of the optical sensor may alternatively has an oblong shape. It is preferred that the light emitting section emits light having a desirable coherence. Poor phase or straightness of light may become a disturbance that hinders the improvement of the measurement accuracy. In view of this, a bundle of optical fibers may be provided so that the emitted light is passed therethrough. Alternatively, the light emitting section may be divided into a plurality of regions so that light is emitted from the plurality of regions successively at regular intervals, thereby avoiding interference of light emitted from adjacent light emitting devices to improve the measurement accuracy. Alternatively, light maybe emitted from the light emitting section via a filter capable of making the emitted light coherent. Note that emitted light does not have to be visible light.

Moreover, the first sensor 41 may include a cleaner for cleaning the light receiving section and/or the light emitting section. For example, a spec of dust attached to the light receiving section or the light emitting section may be blown off with air by the cleaner. For example, the first sensor 41 illustrated in FIG. 1B may include an aperture 8 or a gap through which the air is blown in the direction in which the web W runs or in the opposite direction. The air is blown continuously or intermittently by the controller 10. In a case where the air is blown intermittently, the controller 10 may control the air blow so that the air is blown periodically or randomly. Note that if the air is blown through an aperture, or the like, an orifice effect is obtained.

The web guider 2 may further include the display 7. Specifically, the display 7 may be coupled with the controller 10 illustrated in FIG. 5. The display 7 may be a liquid crystal display or a plasma display. An operation screen (FIG. 6A), a settings screen (FIG. 6B), etc., may be displayed on the display 7.

Figure 6A:
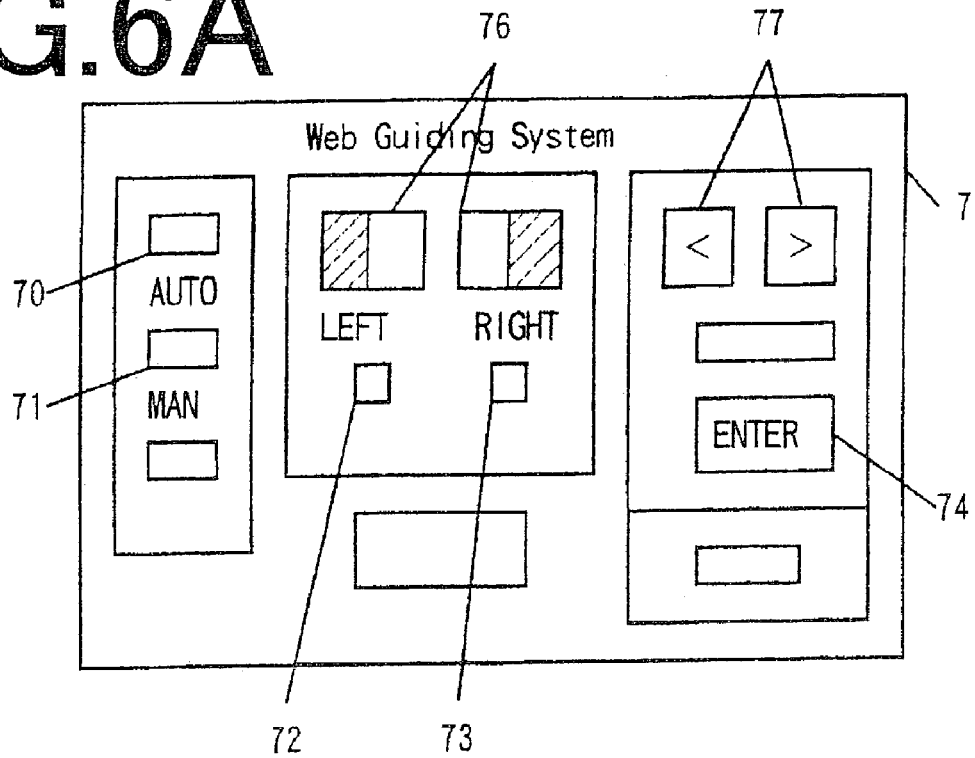
FIG. 6A and FIG. 6B are plan views each illustrating a display screen of a display.

As illustrated in FIG. 6A, on the operation screen of the display 7, an automatic mode button 70, a manual mode button 71, a left sensor button 72, a right sensor button 73, a setting button 74, shift amount display areas 76, swing buttons 77, etc., are displayed. On the setting screen illustrated in FIG. 6B, a numeric keypad 75, etc., are displayed.

The display 7 may be provided on the fixed section 6 illustrated in FIG. 1A, or separately from the fixed section 6. Note that it is preferred that the display 7 is provided within 1.5 m from the web guider 2, which displays information of the first sensor 41. When the display 7 is excessively remote from the web guider 2, and if a wired data line is used, noise is likely to be introduced to the data line. Moreover, the display 7 may be a touch screen.

The controller 10 illustrated in FIG. 5 may measure the amount by which the rail 50 is moved. For example, the motor M may output a predetermined signal each time the motor M is spun by a predetermined amount (e.g., a number of turns, which may be less than one), and the controller 10 may count the number of the predetermined signals, thereby measuring the amount by which the rail 50 is moved. Alternatively, the controller 10 may determine the position of the rail 50 by detecting a mark on the rail 50. For example, a second sensor for reading such a mark put on the rail 50, and the controller 10 may receive positional information from the second sensor. Particularly, the mark may indicate the limit to which the movable section 5 can be swung. In such a case, the controller 10 may stop the spinning of the driving unit when the second sensor detects the limit.

The operation of the web guider, where optical sensors are used as the pair of first sensors 41, will now be described.

First, the operation of the web guider 2 in an automatic mode will be described.

Before the operation in the automatic mode, the operator calibrates the first sensors 41. Note that once the calibration of the position of the first sensors 41 is done, it does not have to be performed again unless a web of a different width is used.

The first sensors 41 are operated to perform the detection operation while the web W is not passed around the rollers 30 and 31. Then, the web W is passed around the rollers 30 and 31, and the first sensors 41 are moved to positions at which both edges of the web W can be detected by the first sensors 41, according to the width Ww of the web W. The operator calibrates the positions of the first sensors 41 based on the positions of the edges of the web W displayed on the shift amount display areas 76 illustrated in FIG. 6A.

Figure 6B:
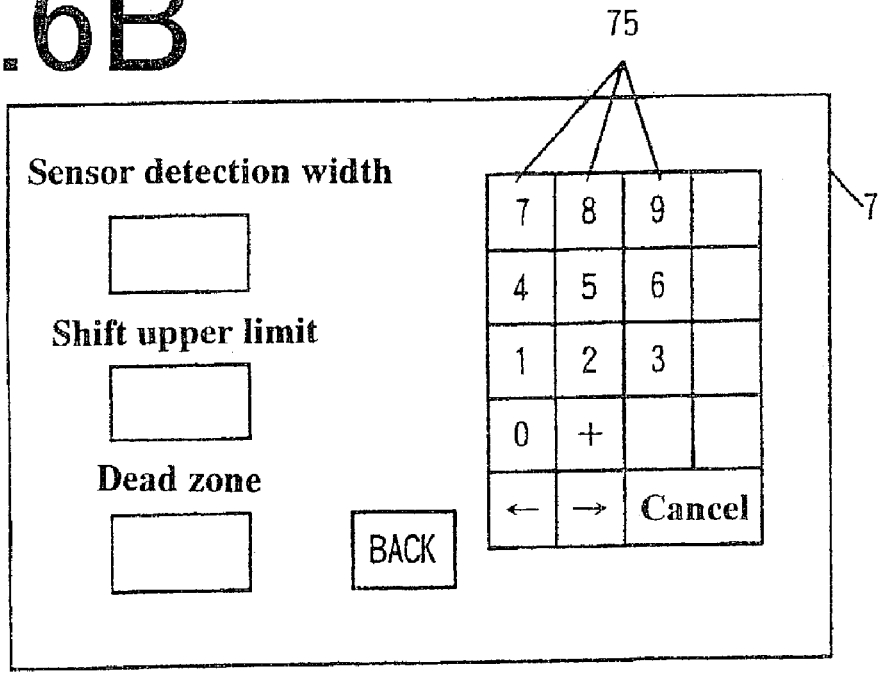

The operator may perform a predetermined operation to have the setting screen illustrated in FIG. 6B displayed, and change the preset initial values by using the numeric keypad 75. On the setting screen, various settings can be changed, e.g., the sensor detection width, the shift upper limit, the dead zone, etc. The sensor detection width is a value associated with the width of an edge of the web W to be detected by the first sensors 41. The shift upper limit is a value based on which the motor M is controlled so that the corrected path of the web W is not beyond the detection range of the first sensors 41. The dead zone is a value representing the range (guiding point) in which the first sensors 41 perform the detection operation.

Then, the operator touches the automatic mode button 70, and the sensor buttons 72 and 73 to initiate the transfer of the web W. Note that in a case where only one of the pair of first sensors 41 is used, only one of the left and right sensor buttons 72 and 73 is touched.

According to the detection signals from the first sensors 41, the controller 10 spins the motor M to swing the rollers 30 and 31 to the left and to the right to correct the path of the web W. For example, when the web W is shifted to the left as illustrated in FIG. 3C, the controller 10 spins the motor M so as to swing the rollers 30 and 31 illustrated in FIG. 3A in the clockwise direction (i.e., a direction opposite to the direction in which the web W is shifted) to move the path of the web W to the right. On the other hand, when the web W is shifted to the right, the rollers 30 and 31 are swung in the counterclockwise direction (i.e., a direction opposite to the direction in which the web W is shifted) to move the path of the web W to the left. The controller 10 repeatedly swings the rollers 30 and 31 to correct the path of the web W according to the detection signals from the first sensors 41.

Thus, the rollers 30 and 31 of the movable section 5 are swung according to the amount by which the web W is shifted, which is detected by the first sensors 41, and the tension on each edge of the web W is controlled by the rollers 30 and 31, thereby correcting the path of the web W.

As necessary, the operator operates the web guider 2 in the manual mode. As the operator touches the manual mode button 71 on the display 7, the CPU 10*a* is set in the manual mode. The operator touches the right or left swing button 77 to swing the rollers 30 and 31 so as to correct the path of the web W.

Figure 7:
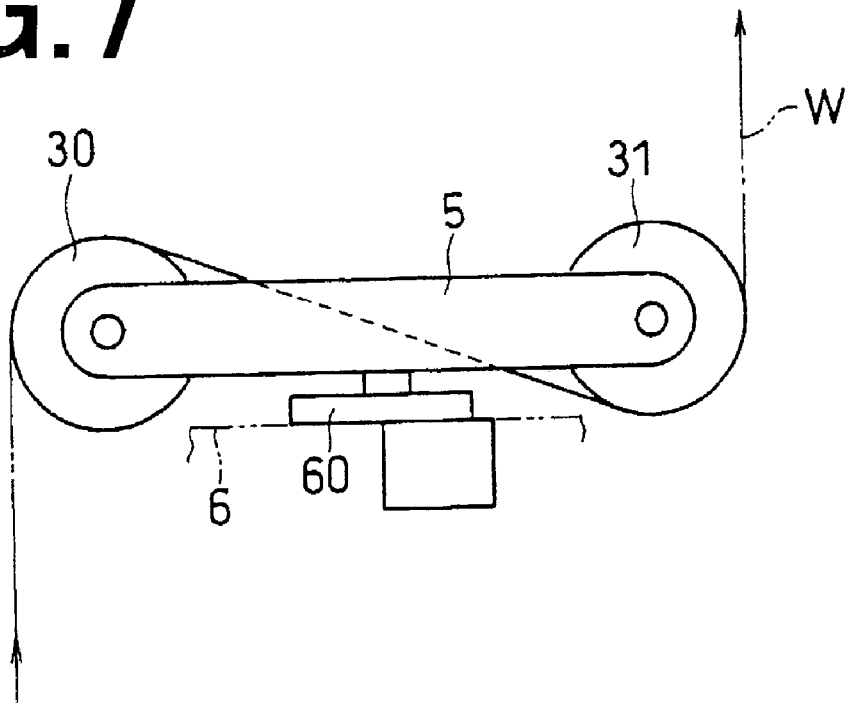
FIG. 7 is a schematic side view illustrating a variation of the embodiment of the present invention.

Note that the web W may be passed around the rollers 30 and 31 in an N- or S-shaped pattern as illustrated in FIG. 7.

As described above, according to the present invention, the follower for transmitting the driving force from the driver to the movable section has a shape conforming to the curvature of the rail, thereby providing an increased linearity between the angle by which the rollers are swung and the amount by which the driver is driven even if the swing angle of the rollers is increased. Therefore, it is possible to easily and accurately control the swing angle of the rollers.

Particularly, with the center about which the movable section is swung being located closer to the inlet roller than to the outlet roller, the displacement of the inlet roller, occurring when the orientation of the inlet roller is changed, can be reduced, thereby reducing the creasing of the web.

Moreover, with the provision of a guide rail curved in an arc shape, the swinging of the movable section can be realized simply and reliably.

Moreover, if the shift in the path of the web is detected, and the motor is controlled based on the detection output, so that the shift can be corrected automatically, the web guider can run in a continuous, automated operation.

Furthermore, if the detected shift amount of the web is displayed on the display, the position at which to place the detector can be known easily, thereby significantly facilitating the operation and maintenance of the apparatus.

Moreover, since the web is transferred along a generally U-shaped path, the motor, etc., can be placed in the space inside the generally U-shaped path, thereby improving the space efficiency. Furthermore, if the operation section is provided on one side of the space, operations such as an initial setting operation can be performed while visually observing the shift of the web, thereby significantly improving the operability of the web guider with respect to the various setting operations.

What is claimed is:

1. A web guider for correcting a path of a web, the web guider comprising:

a movable section, comprising:

an inlet roller for picking up the web and an outlet roller for releasing the web, wherein the web contacts each of the inlet roller and the outlet roller at a respective side surface thereof;

a rail having an arcuate shape; and a rack having a shape generally conforming to the shape of the rail, wherein the rack is fixedly coupled to the rail; and a fixed section, comprising:

a plurality of guide rollers, wherein the plurality of guide rollers are in rotational engagement with the rail, therein defining a center of rotation of the movable section;

a pinion, wherein the pinion is in rotational engagement with the rack; and a motor fixedly coupled to the fixed section and operable to transmit a rotational driving force to the pinion, wherein an orientation of the movable section with respect to the fixed section is controlled by the transmitted rotational driving force.

2. The web guider of claim 1, wherein the center about which the movable section rotates is located closer to the inlet roller than to the outlet roller.

3. The web guider of claim 1, wherein a length of each of the inlet roller and outlet roller is greater than a width of the web, and wherein a distance between the side surfaces of the inlet roller and outlet roller is set to be ½ or more of the width of the web.

4. The web guider of claim 1, further comprising:

a detector operable to detect a reference position of the web, wherein the path of the web is generally defined by the detected reference position, and wherein the detector is operable to provide positional information associated with the path; and a controller operable to control the driving force provided to the pinion by the motor, wherein the control is based on the positional information.

5. The web guider of claim 4, wherein the detector is operable to detect an edge of the web, therein defining the reference position of the web, and wherein the web guider further comprises a display for displaying the reference position.

6. The web guider of claim 5, wherein the detector comprises a pair of first sensors, wherein each of the first sensors is operable to detect respective opposing edges of the web.

7. The web guider of claim 5, wherein the detector comprises a pair of first sensors, wherein each of the first sensors is operable to detect a common edge of the web.

8. The web guider of claim 4, wherein the detector is operable to detect a graphical pattern printed on the web, therein defining the reference position of the web, and wherein an image processing operation generates the positional information.

9. The web guider of claim 1, wherein the motor comprises a stepping motor operably coupled to a controller, wherein the controller is operable to control a rotation of the pinion.

10. The web guider of claim 9, wherein the motor is operable to provide a predetermined signal to the controller each time the pinion is rotated a predetermined amount, and wherein the controller is operable to determine the orientation of the movable section with respect to the fixed section based on a number of predetermined signals provided from the motor.

11. A web guider for correcting a path of a web, the web guider comprising:

a fixed section, comprising:

a rail having an arcuate shape; and a rack having a shape generally conforming to the shape of the rail, wherein the rack is fixedly coupled to the rail; and a movable section, comprising:

an inlet roller for picking up the web and an outlet roller for releasing the web, wherein the web contacts each of the inlet roller and the outlet roller at a respective side surface thereof;

a plurality of guide rollers, wherein the plurality of guide rollers are in rotational engagement with the rail, therein defining a center of rotation of the movable section;

a pinion, wherein the pinion is in rotational engagement with the rack; and a motor fixedly coupled to the movable section and operable to transmit a rotational driving force to the pinion, wherein an orientation of the movable section with respect to the fixed section is controlled by the transmitted rotational driving force.

12. The web guider of claim 11, wherein the center about which the movable section rotates is located closer to the inlet roller than to the outlet roller.

13. The web guider of claim 11, wherein a length of each of the inlet roller and outlet roller is greater than a width of the web, and wherein a distance between the side surfaces of the inlet roller and outlet roller is set to be ½ or more of the width of the web.

14. The web guider of claim 11, further comprising:

a detector operable to detect a reference position of the web, wherein the path of the web is generally defined by the detected reference position, and wherein the detector is operable to provide positional information associated with the path; and a controller operable to control the driving force provided to the pinion by the motor, wherein the control is based on the positional information.

15. The web guider of claim 14, wherein the detector is operable to detect an edge of the web, therein defining the reference position of the web, and wherein the web guider further comprises a display for displaying the reference position.

16. The web guider of claim 15, wherein the detector comprises a pair of first sensors, wherein each of the first sensors is operable to detect respective opposing edges of the web.

17. The web guider of claim 15, wherein the detector comprises a pair of first sensors, wherein each of the first sensors is operable to detect a common edge of the web.

18. The web guider of claim 14, wherein the detector is operable to detect a graphical pattern printed on the web, therein defining the reference position of the web, and wherein an image processing operation generates the positional information.

19. The web guider of claim 11, wherein the motor comprises a stepping motor operably coupled to a controller, wherein the controller is operable to control a rotation of the pinion.

20. The web guider of claim 19, wherein the motor is operable to provide a predetermined signal to the controller each time the pinion is rotated a predetermined amount, and wherein the controller is operable to determine the orientation of the movable section with respect to the fixed section based on a number of predetermined signals provided from the motor.

* * * * *